US005887560A

United States Patent [19]

Kobayashi

[11] Patent Number: 5,887,560

[45] Date of Patent: Mar. 30, 1999

[54] SUPPORT STRUCTURE FOR INTAKE SYSTEM OF INTERNAL COMBUSTION ENGINE

[75] Inventor: Tetsuya Kobayashi, Shizuoka-ken, Japan

[73] Assignee: Suzuki Motor Corporation, Shizuoka, Japan

[21] Appl. No.: 121,441

[22] Filed: Jul. 23, 1998

[30] Foreign Application Priority Data

Jul. 31, 1997 [JP] Japan ..... 9-220208

[51] Int. Cl.[6] ..... F02M 35/10

[52] U.S. Cl. ..... 123/184.21; 125/195 A

[58] Field of Search ..... 123/184.21, 184.24, 123/184.34, 184.42, 184.47, 195 R, 195 A

[56] References Cited

U.S. PATENT DOCUMENTS

| | | | |
|---|---|---|---|
| 4,776,313 | 10/1988 | Freismuth et al. | 123/470 |
| 4,829,944 | 5/1989 | Sukimoto et al. . | |
| 4,887,557 | 12/1989 | Sukimoto et al. . | |
| 5,012,770 | 5/1991 | Okamoto et al. | 123/184.42 |

FOREIGN PATENT DOCUMENTS

| | | | |
|---|---|---|---|
| 404124453 | 4/1992 | Japan | 123/184.21 |
| 404124455 | 4/1992 | Japan | 123/184.21 |
| 5-65857 | 3/1993 | Japan . | |
| 6-5061 | 1/1994 | Japan . | |
| 7-45853 | 5/1995 | Japan . | |
| 2539226 | 7/1996 | Japan . | |
| 2518964 | 9/1996 | Japan . | |

*Primary Examiner*—Willis R. Wolfe
*Assistant Examiner*—Hai Huynh
*Attorney, Agent, or Firm*—Flynn, Thiel, Boutell & Tanis, P.C.

[57] ABSTRACT

A support structure for an intake system of an internal combustion engine. The support structure includes first and second mount portions provided on an engine-mounting flange portion of an intake manifold, the intake manifold being fitted to the engine by the engine-mounting flange portion, and a third mount portion is disposed on a throttle body-mounting flange portion of a surge tank, the throttle body being mounted on the surge tank through the throttle body-mounting flange portion. The support structure also includes an intake manifold stiffener having a substantially triangular shape which includes first, second, and third mounting sections at the corners thereof. These mounting sections are engaged with the first, second, and third mount portions, respectively. Accordingly, the surge tank is supported by the triangular configuration of the intake manifold stiffener. In addition, the first and second mounting sections have a greater length in the direction of each mounting axis thereof to define additional space for accommodating other engine components.

13 Claims, 6 Drawing Sheets

SUPPORT STRUCTURE FOR INTAKE SYSTEM OF INTERNAL COMBUSTION ENGINE

FIELD OF THE INVENTION

This invention relates to a support structure for an intake system of an internal combustion engine. More particularly, it relates to a support structure including an intake manifold stiffener having a substantially triangular shape for supporting a surge tank. The substantially triangular shape includes first, second, and third engagement portions or mounting sections which are engaged with first, second, and third mount portions, respectively, and the first and second mounting sections of the stiffener are greater in length in the direction of each mounting axis thereof. The intake manifold stiffener enables the support structure to be capable of: reliably providing increased rigidity, while avoiding components located in an internal space; restraining deformation; reducing vibrations that adversely affect sensors on the surge tank or the throttle body; enabling the internal space surrounded by the intake manifold and the intake manifold stiffener to be made greater than in conventional structures, as a result of which easy layout is achievable without interference with the components located in this internal space, and thus improved rigidity and ease in layout are achievable.

BACKGROUND OF THE INVENTION

An internal combustion engine typically has a throttle body and a surge tank arranged in sequence from the upstream side of an intake system, or rather an intake manifold. The intake manifold and the surge tank communicate with one another through an intake manifold stiffener.

One such example of a support structure for an 35 intake system is disclosed in published Laid-Open Japanese Patent Application No. 5-65857. In the support structure disclosed therein, a throttle body-mounting flange portion is provided at a collection portion (i.e., a surge tank portion) of an intake manifold. The intake manifold is made of resin or steel pipe, and has a plurality of individual intake passage portions extending toward the collection portion from an engine body in a downwardly curved manner. The intake passage portions are mounted at downstream ends thereof to the engine body, but are connected at upstream ends thereof to the surge tank portion. In addition, a stay member, whose one end is mounted on the engine body, is engaged at the other end thereof with the above-mentioned throttle body-mounting flange portion. As a result, the intake manifold is supported at the surge tank portion by means of the stay member.

Another example of such a support structure is disclosed in published Japanese Utility Model Registration No. 2518964. The support structure for the intake manifold as disclosed therein includes a surge tank and a branch pipe arrangement. The branch pipe arrangement is integrally connected at the top thereof to the surge tank, while being joined at the bottom thereof to one sidewall of a cylinder head. A reinforcement portion is provided on an outer surface of the outermost branch pipe of the branch pipe arrangement. The reinforcement portion has a greater thickness at a location approximately midway from a proximal end of the branch pipe positioned toward the engine body. Further, an upper support stay extends between a proximal end of the reinforcement portion and an outer end portion of the surge tank. In addition, a lower support stay extends between a distal end of the reinforcement portion and a cylinder block skirt portion or mission case.

In conventional support structures for the intake system of the internal combustion engine and, particularly, in intake manifold stiffeners for supporting the surge tank on the upper sides of branch pipes of the intake manifold, the surge tank being attached on the upstream side of the intake manifold, a great number of intake manifold stiffeners are available that are made of either simply structured metal plates or steel pipes. However, the above-mentioned intake manifold stiffeners are typically unable to control vibrations of the surge tank or throttle body. The surge tank and the throttle body each have respective sensors fitted thereto, and such vibrations are an inconvenience since they can adversely affect the sensors, which is disadvantageous in practical use.

In addition, a large number of the above stiffeners are designed for mounting at two locations in total. More specifically, such an intake manifold stiffener is mounted both on the surge tank at one location and on an engine-mounting flange portion of the intake manifold at another location. The intake manifold is mounted on the engine through the engine-mounting flange portion. Such a mounting method is typically unable to control deformation; therefore there has been a continuous demand for an improved mounting method.

A further inconvenience is that the stiffener cannot be provided at a location which effectively increases the rigidly of the stiffener due to the positioning of an injector, a fuel delivery pipe, a harness, a throttle body, and accelerator cable, etc., on the upper side of the intake manifold. This is disadvantageous in practical use.

SUMMARY OF THE INVENTION

In order to minimize or obviate the above inconveniences, the present invention provides a support structure for an intake system of an internal combustion engine which includes a surge tank positioned on the upstream side of an intake manifold and a throttle body located on the upstream side of the surge tank, and further includes an intake manifold stiffener for interconnecting the intake manifold and the surge tank. The support structure has first and second mount portions provided on an engine-mounting flange portion of the intake manifold, which intake manifold is fitted on the engine by means of the engine-mounting flange portion. A third mount portion is disposed on a throttle body-mounting flange portion of the surge tank, which throttle body is mounted on the surge tank by means of the throttle body-mounting flange portion. The support structure also includes an intake manifold stiffener having a substantially triangular shape which includes first, second, and third mounting sections. These mounting sections are engaged with first, second, and third mount portions, respectively. Accordingly, the surge tank is supported by the triangular configuration of the stiffener. In addition, the first and second mounting sections of the stiffener have a greater length in the direction of each mounting axis thereof.

With the above construction, when the intake manifold stiffener is mounted, the first and second mounting sections of the stiffener are mounted on the first and second mount portions of the engine-mounting flange portion, respectively, while the third mounting section of the stiffener is fitted to the third mount portion of the throttle body-mounting flange portion. In this way, the support structure has increased rigidity, while avoiding engine components located in an internal space adjacent the intake manifold. In addition, the support structure reduces distortion or deformation, and further reduces vibrations that adversely affect sensors located on the surge tank or the throttle body. Moreover, the internal space surrounded by the intake manifold and the stiffener is made greater than in conventional structures. As a result, improved rigidly and ease in layout are achievable.

BRIEF DESCRIPTION OF THE DRAWINGS

An embodiment of the present invention will now be described in detail with reference to the drawings, in which.

DETAILED DESCRIPTION

Figure 1:
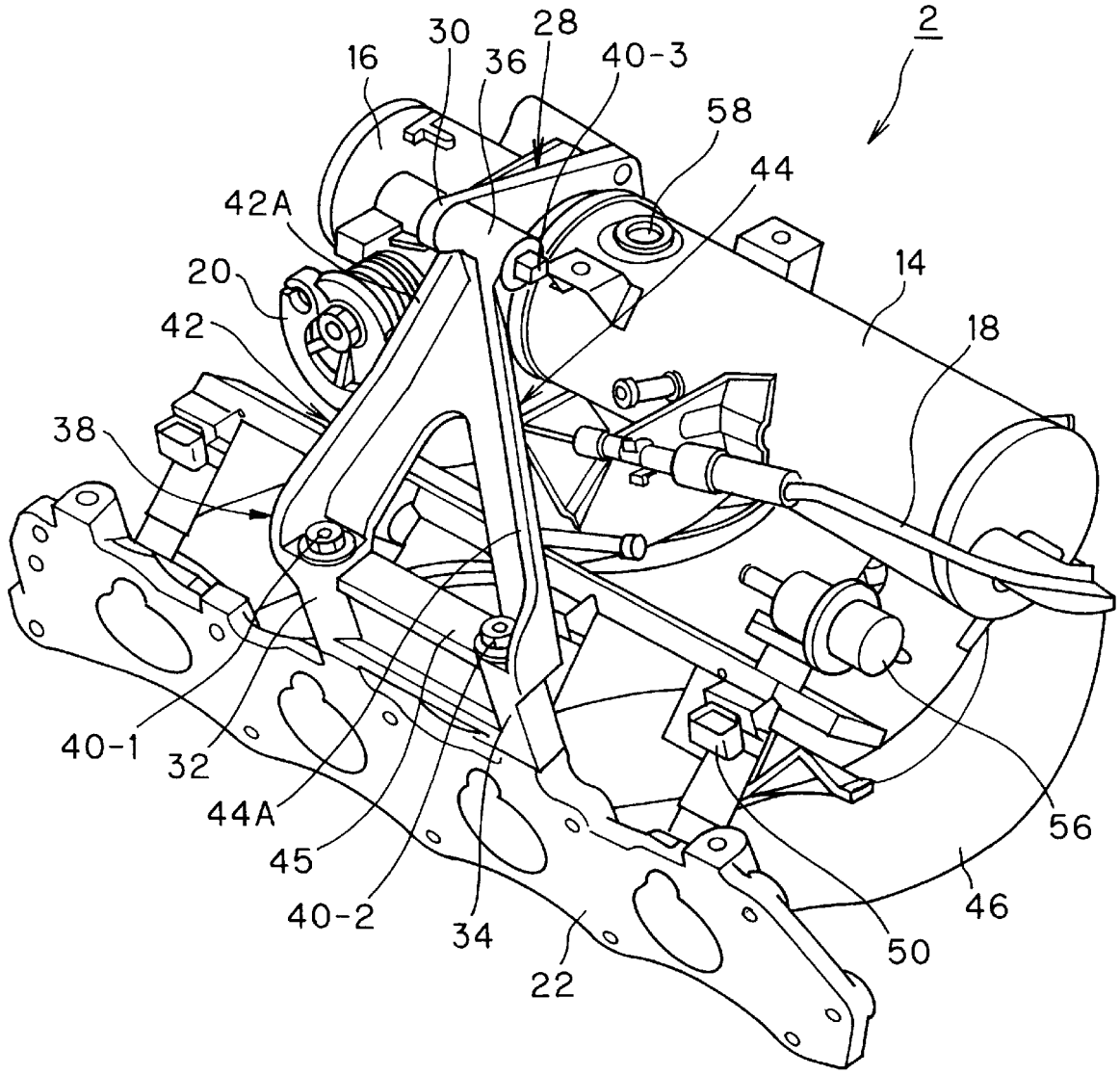
FIG. 1 is a perspective view illustrating an intake manifold according to the present invention.
Figure 2:
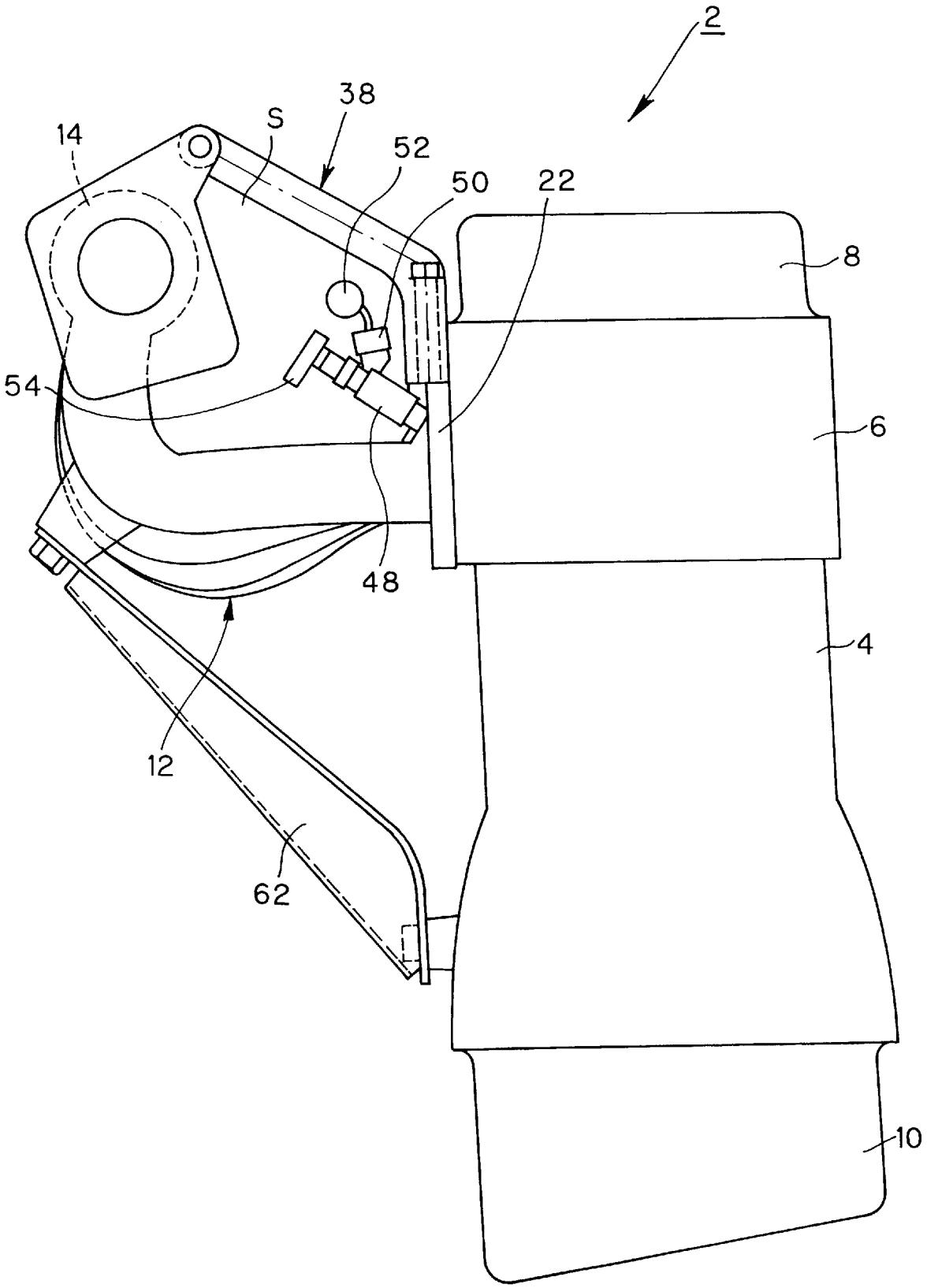
FIG. 2 is a left side view thereof and also showing an internal combustion engine.
Figure 3:
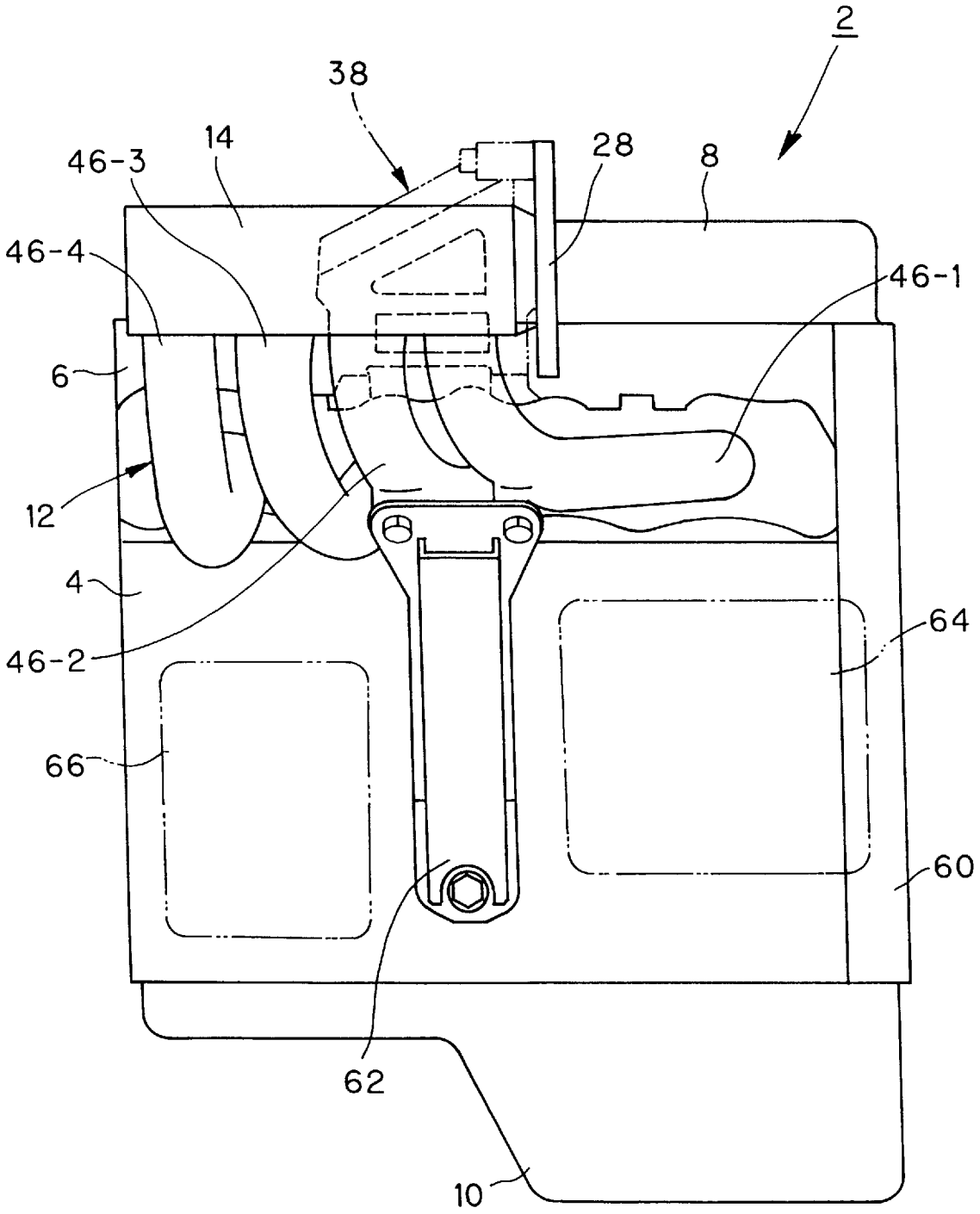
FIG. 3 is a rear view thereof and also showing the engine.

FIGS. 1–6 illustrate a preferred embodiment of the invention. In FIGS. 1–3, reference numeral 2 denotes an internal combustion engine; 4 a cylinder block; 6 a cylinder head; 8 a cylinder head cover; 10 an oil pan; 12 an intake manifold; 14 a surge tank which is part of the intake manifold; and 16 a throttle body. Specifically, the engine 2 includes the cylinder block 4 whereby the cylinder head 6 is attached to the top of the block 4, the cylinder head cover 8 is fitted to the cylinder head 6, and the oil pan 10 is affixed to the underside of the cylinder block 4.

The surge tank 14 is located on the upstream side of the intake manifold 12. The throttle body 16 is provided on the upstream side or end of the surge tank 14. An engine-mounting flange portion 22 of the intake manifold 12, which flange portion 22 is located on the downstream side of the intake manifold 12, is connected to the cylinder head 6. The throttle body 16 has a throttle shaft (not shown) disposed thereon for opening and closing a throttle valve. A throttle lever 20 is positioned at the end of the throttle shaft for communication with an accelerator cable 18.

In the illustrated arrangement, the engine 2 extends horizontally transverse of the vehicle in which it is mounted, i.e., transverse to the direction of vehicle movement, and the intake manifold 12 and surge tank 14 are mounted adjacent the rear side of the engine relative to the normal forward direction of the vehicle.

Figure 4:
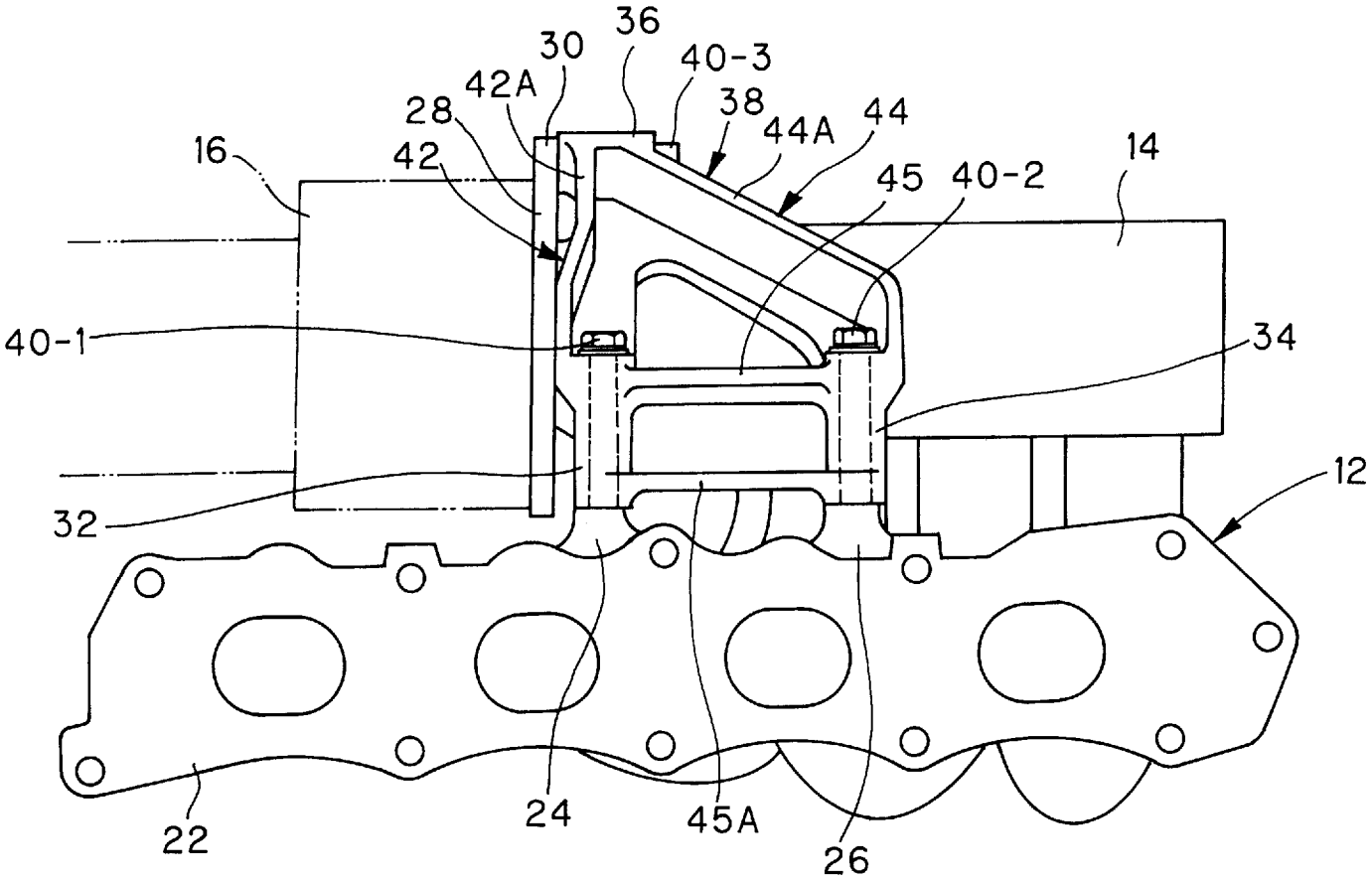
FIG. 4 is a front view thereof, without the engine.
Figure 5:
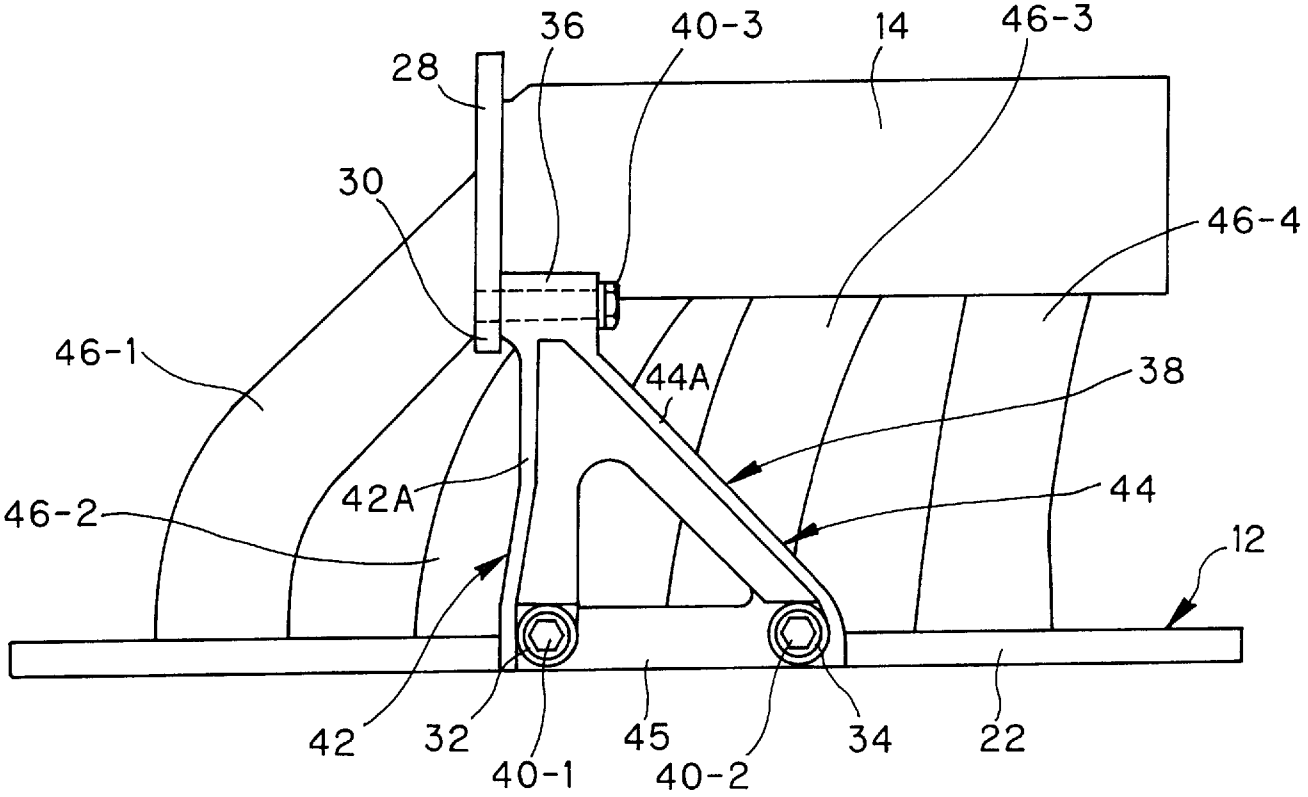
FIG. 5 is a plan view thereof, without the engine.
Figure 6:
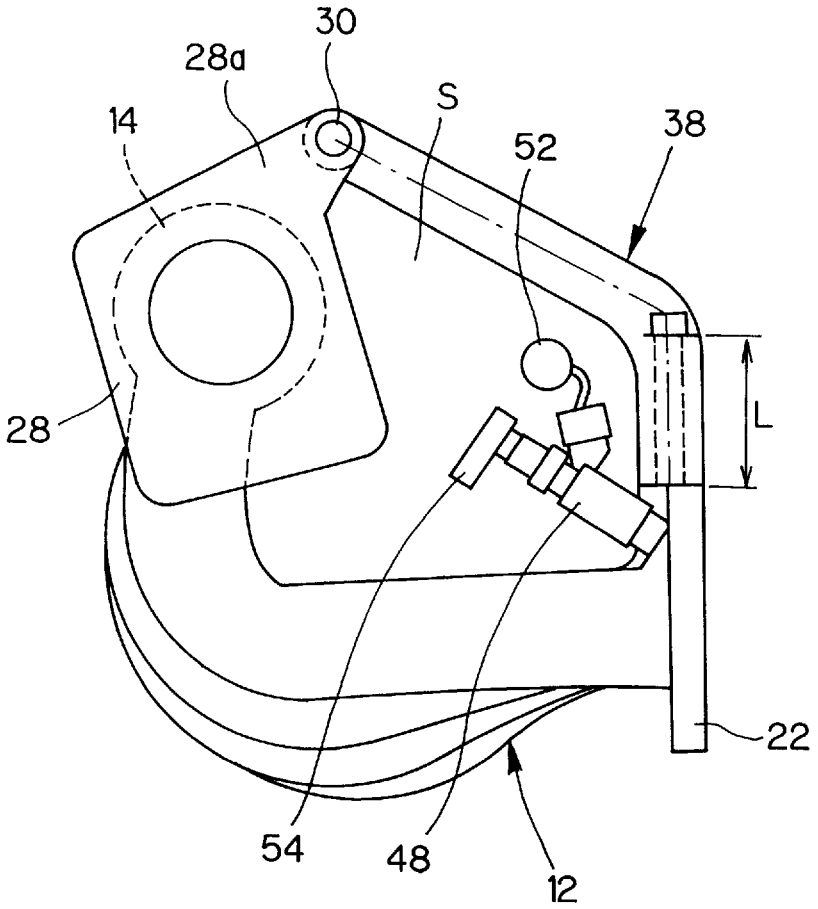
FIG. 6 is a left side thereof, without the engine.

Referring to FIGS. 4–6, the engine-mounting flange portion 22, by means of which the intake manifold 12 is attached to the engine 2, includes first and second coplanar mount portions 24 and 26. A third mount portion is provided on and forms part of a throttle body-mounting flange portion 28 of the surge tank 14. The throttle body 16 is mounted on the surge tank 14 by means of the throttle body-mounting flange portion 28, and the third mount portion 30 preferably projects generally upwardly and forwardly from the surge tank 14. Further, an intake manifold stiffener 38 is provided. The stiffener 38 has a substantially open triangular shape (when viewed from the top) and includes first, second, and third engagement portions or mounting sections 32, 34, and 36, each of which portions 32, 34 and 36 comprises an elongate sleeve or hub having a hole therethrough for receiving a fastener such as a bolt. These engagement portions 32, 34, and 36 are engaged with the first, second, and third mount portions 24, 26, and 30, respectively, and are attached thereto by means of bolts 40-1, 40-2 and 40-3. Accordingly, the surge tank 14 is supported by the triangular configuration of the stiffener 38. In addition, the first and second mounting sections 32 and 34 are greater in length in the direction of each mounting axis thereof (i.e., along the axis of the bolt) than the mounting section 36.

More specifically, the first mount portion 24 is positioned substantially centrally on the engine-mounting flange portion 22, and the second mount portion 26 is provided at a location on engine-mounting flange portion 22 spaced apart from the first mount portion 24. The third mount portion 30 is formed on a flange extension portion 28*a* (FIG. 6) of the throttle body-mounting flange portion 28.

The intake manifold stiffener 38 is a rigid one-piece member and is formed into a substantially triangular shape (when viewed from the top) by means of a casting that is preferably made of aluminum or iron. The first, second, and third mounting sections 32, 34, and 36 are provided respectively at the three corners of the triangular stiffener. These mounting sections 32, 34, and 36 are attached to the first, second, and third mount portions 24, 26, and 30, respectively. The third mounting section 36 extends substantially parallel to the central longitudinal axis of the surge tank 14. Further, the first and second mounting sections 32 and 34 extend transversely with respect to the surge tank axis and preferably are substantially perpendicular thereto, and have a greater length "L" (FIG. 6) in the direction of the mounting axis thereof. Mounting bolts 40-1 and 40-2 are inserted into mounting sections 32 and 34 and likewise have a greater length for a purpose as discussed below.

Further, the intake manifold stiffener 38 is constructed to permit suspension and support of the intake manifold 12 by means of the first and second mount portions 24 and 26 of the engine-mounting flange portion 22. In addition, the greater length "L" (FIG. 6) of the mounting sections 32 and 34 enables enlargement of an internal space "S" that is surrounded or defined by the intake manifold 12 and the stiffener 38. As illustrated in FIGS. 2 and 6, the stiffener 38 is bent toward the throttle body 16, and the third mounting section 36 thereof is fastened to the third mount portion 30 provided on the throttle body-mounting flange portion 28 of the surge tank 14 by bolt 40-3. As a result, the stiffener 38 is configured to support the throttle body 16 closely adjacent to the stiffener 38.

Turning now to FIGS. 4 and 5, the stiffener 38 includes first and second upper connection legs or ribs 42 and 44. The first upper rib 42 extends between and interconnects the first and third mounting sections 32 and 36, and the second upper rib 44 extends between and interconnects the second and third mounting sections 34 and 36. Third and fourth lower legs or ribs 45 and 45A are spaced-apart from one another and extend transversely between and interconnect the first and second mounting sections 32 and 34. Further, each of the upper ribs 42 and 44 respectively includes an upwardly extending elongate flange 42A and 44A such that each rib 42 and 44 has a substantially L-shaped cross-section which provides rigidly thereto. The upper ribs 42 and 44 preferably angle upwardly and rearwardly from the first and second mounting sections 32 and 34 towards the surge tank 14.

Further, as illustrated in FIGS. 2–5, when the surge tank 14 is positioned toward the rear of the engine 2, at least one of the first and second ribs 42 and 44 are slanted or angled in a direction opposite to a direction in which branch pipes 46-1, 46-2, 46-3, and 46-4 of the intake manifold 12 are angled.

More specifically, as illustrated in FIG. 5, the intake manifold 12 includes four branch pipes 46-1, 46-2, 46-3, and 46-4. Manifold 12 extends forwardly from the surge tank 14 towards the engine 2 and the second rib 44 of the stiffener 38 is positioned so as to be angled in a direction opposite to the slanted direction of the second and third branch pipes 46-2 and 46-3. In this regard, the second/third branch pipes 46-2, 46-3 and the second rib 44 simply extend in a transverse relationship to each other. It should be noted, however, that when these components are arranged in a perpendicular relationship to each other, rigidity is further enhanced or increased.

With reference to FIGS. 1–3 and 6, numeral 48 denotes an injector located in internal space "S"; 50 a coupler; 52 a harness; 54 a fuel delivery pipe; 56 a pressure regulator; 58 a pressure sensor-mounting hole; 60 a chain cover; 62 another stiffener which is mounted at an opposite side of intake manifold 12 from the stiffener 38; 64 an auxiliary machine space; and 66 a mount space.

The structure and advantages of the invention are summarized below.

To mount the intake manifold stiffener 38, the first and second mounting sections 32 and 34 thereof are fitted to the first and second mount portions 24 and 26 of the engine-mounting flange portion 22 by means of the mounting bolts 40-1 and 40-2, respectively. The intake manifold 12 is thereby suspendingly supported by the stiffener 38. In addition, the third mounting section 36 is secured to the third mount portion 30 formed on the throttle body-mounting flange 28 of surge tank 14 by means of the mounting bolt 40-3. The throttle body 16 is thereby supported by the stiffener 38. In addition, internal space "S" is formed, which space is surrounded by the intake manifold 12 and the stiffener 38.

As a result of the above-discussed arrangement in accordance with the invention, the stiffener 38 reliably provides increased rigidity while avoiding interference with injector-related components or other components such as an accelerator cable located in internal space "S". In addition, it is possible to avoid or reduce deformation, and further to reduce vibrations that adversely affect sensors mounted on the surge tank 14 or the throttle body 16. Moreover, the increased length "L" of the first and second mounting sections 32 and 34 (in the direction of each mounting axis thereof) enables enlargement of internal space "S" surrounded by the intake manifold 12 and the stiffener 38 as compared to conventional structures. As a result, easy layout is achievable without interference with the components located in space "S", and thus the rigidity requirements and layout are compatible. This feature is advantageous in practical use. In addition, since the stiffener 38 supports the intake manifold 12 in a suspended manner, an improvement in rigidity is attached. This is advantageous generally for intake manifolds having reduced rigidity.

Further, the third mounting section 36 of stiffener 38 engaged with the third mount portion 30 is positioned at the throttle body-mounting flange portion 28 of the surge tank 14, and thus the throttle body 16 is supported adjacent to the stiffener 38. As a result, it is possible to enhance the rigidity of the throttle body 16, on which an external force is exerted. This is advantageous in practical use.

Moreover, since the surge tank 14 is positioned toward the rear of the engine 2, the stiffener 38 angles in a direction opposite to the direction in which the branch pipes 46 of the intake manifold 12 are angled. As a result, the stiffener 38 extends in a direction opposite to the direction in which the branch pipes 46 are vibrated. Such a construction provides enhanced rigidity to the branch pipes 46 and thus reduces vibrations.

In addition, the first, second and third mounting sections 32, 34, and 36 of stiffener 38 are arranged in a generally common planar relationship with each other and are arranged in a substantially triangular shape (when viewed from the top) in such a common plane. Such a configuration provides ease in assembly and a stabilized support structure.

Moreover, when the branch pipes 46-1, 46-2, 46-3 and 46-4 are fabricated by casting, increased rigidity of the branch pipes is achieved by providing the intake manifold 12 with a greater thickness at a portion where the branch pipes 46-1, 46-2, 46-3 and 46-4 are mounted. However, when the branch pipes are made of iron such as a steel pipe and have a substantially uniform thickness, then the branch pipes have a relatively reduced rigidity. By using the support structure according to the present invention it is possible to provide increased rigidity to such branch pipes made of steel pipes.

As described above, the support structure for the intake system of the internal combustion engine according to the present invention includes a surge tank positioned on the upstream side of an intake manifold and a throttle body located on the upstream side of the surge tank, and further includes an intake manifold stiffener for interconnecting the intake manifold and the surge tank. First and second mount portions are provided on an engine-mounting flange portion of the intake manifold, the intake manifold being fitted to the engine through the engine-mounting flange portion. A third mount portion is disposed on a throttle body-mounting flange portion of the surge tank, the throttle body being mounted on the surge tank through the throttle body-mounting flange portion. The support structure further includes an intake manifold stiffener having a substantially triangular shape which includes first, second, and third engagement portions or mounting sleeves. These mounting sleeves are engaged or attached to the first, second, and third mount portions, respectively. Accordingly, the surge tank is supported by the triangular configuration of the intake manifold stiffener. In addition, the first and second mounting sleeves of the stiffener are greater in length in the direction of the mounting axis thereof, and as a result it is possible to reliably provide increased rigidity, while avoiding injector-related components or other components such as an accelerator cable, which components are all located in an internal space adjacent the intake manifold. It is also possible to minimize or prevent deformation, and to reduce vibrations that adversely affect sensors associated with the surge tank or the throttle body.

Moreover, since the first and second mounting sleeves of the stiffener have a greater length as discussed above, then internal space defined by the intake manifold and the stiffener can be made greater than in conventional structures. As a result, easy layout is achievable without interference with the components located in this space, and the rigidity and layout are thus compatible, which is advantageous in practice use.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A support structure for an intake system of an internal combustion engine, the intake system including a surge tank positioned on an upstream side of an intake manifold and a throttle body located on an upstream side of said surge tank, and further including an intake manifold stiffener for interconnecting said intake manifold and said surge tank, said support structure having first and second mount portions provided on an engine-mounting flange portion of said intake manifold, said intake manifold being fitted to said engine by means of said engine-mounting flange portion, and a third mount portion disposed on a throttle body-mounting flange portion of said surge tank, said throttle body being mounted on said surge tank by means of said throttle body-mounting flange portion, wherein said stiffener has a substantially triangular shape for supporting said surge tank, said stiffener including first, second, and third mounting sections which are fastened to said first, second, and third mount portions, respectively, and said first and second mounting sections having a greater length in the direction of each mounting axis thereof.

2. The support structure as defined in claim 1, wherein said stiffener is configured to suspendingly support said intake manifold by means of said first and second mount portions, and wherein said greater length of said first and second mounting sections enable enlargement of an internal space adjacent said intake manifold, and said stiffener being bent toward said throttle body to enable fastening of said third mounting section to said third mount portion, whereby said third mounting section is configured and disposed to support said throttle body.

3. The support structure as defined in claim 1, wherein said surge tank is positioned toward the rear of said engine and said stiffener has a connection rib angled in a direction opposite to a direction in which branch pipes of said intake manifold are angled.

4. A support structure assembly for an intake system of an internal combustion engine, the intake system including an intake manifold having a plurality of branch pipes and a surge tank disposed at an upstream end of the intake manifold, and a throttle body disposed at an upstream end of the surge tank, said assembly comprising:

said intake manifold having an engine mounting flange for connecting downstream ends of the branch pipes to the internal combustion engine, said engine mounting flange having first and second mounting portions;

a throttle body mounting flange disposed on the upstream end of the surge tank for connecting the throttle body to the surge tank; and a stiffener for connecting the intake manifold to the surge tank, said stiffener having three legs disposed in a generally triangular configuration, and first, second and third mounting sections each disposed respectively at a different intersection of two of said three legs, said first and second mounting sections being respectively fastened to said first and second mounting portions of said engine mounting flange, and said third mounting section being fastened to a portion of said throttle body mounting flange.

5. The support structure assembly of claim 4, wherein the surge tank and throttle body are disposed rearwardly of the engine, a first of said three legs extends transversely between said first and second mounting sections, and second and third ones of said three legs each extend upwardly and rearwardly at an angle from a respective one of said first and second mounting sections towards said throttle body mounting flange and intersect one another at said third mounting section.

6. The support structure assembly of claim 5, wherein said first and second mounting sections are elongated and define a longitudinal axis transverse to a longitudinal axis of the surge tank and to said first leg, said first and second mounting sections together with said legs and the intake manifold define an interior space in which engine components are located, said first and second mounting sections each have a substantial length along the longitudinal axis thereof to enable enlargement of said space.

7. The support structure assembly of claim 6, wherein said third mounting section is disposed at a vertex of said triangular configuration, said third mounting section being elongate and defining a longitudinal axis substantially parallel to the longitudinal axis of the surge tank.

8. The support structure assembly of claim 4, wherein at least one of said legs extends transversely with respect to at least one of the branch pipes of the intake manifold.

9. The support structure assembly of claim 4, wherein said first and second mounting sections together with said first and second mounting portions of said engine mounting flange suspendingly support the intake manifold, and said third mounting section together with said portion of said throttle body flange support the throttle body and the surge tank.

10. The support structure assembly of claim 4, wherein each of said mounting sections comprises an elongate sleeve having an opening therethrough for accommodating a threaded fastener.

11. The support structure assembly of claim 10, wherein said first and second mounting sections have an axial length which is significantly greater than an axial length of said third mounting section.

12. The support structure assembly of claim 10, wherein said first and second mounting sections are axially elongated vertically downwardly from opposite ends of a first said leg which extends generally horizontally, second and third said legs being respectively joined at opposite ends of said first leg and being angled upwardly and transversely relative to said first leg, said second and third legs being joined at a vertex which is spaced upwardly and transversely from said first leg, and said third mounting section being disposed at said vertex and axially elongated generally parallel with said first leg.

13. The support structure assembly of claim 12, wherein said first and second mounting sections have an axial length which is significantly greater than an axial length of said third mounting section, and wherein threaded fasteners project downwardly through said first and second mounting sections for fixed engagement with said first and second mounting portions.

* * * * *